US006742585B1

(12) United States Patent
Braithwaite et al.

(10) Patent No.: US 6,742,585 B1
(45) Date of Patent: Jun. 1, 2004

(54) SEALING OFF OPENINGS THROUGH THE WALL OF A WELL TUBULAR

(75) Inventors: Stephen Richard Braithwaite, Rijswijk (NL); Wilhelmus Hubertus Paulus Maria Heijnen, Velsen (NL); Pieter Karel Anton Kapteijn, Rijswijk (NL)

(73) Assignee: Shell Oil Company, Houston, TX (US)

( * ) Notice: Subject to any disclaimer, the term of this patent is extended or adjusted under 35 U.S.C. 154(b) by 94 days.

(21) Appl. No.: 10/148,065

(22) PCT Filed: Nov. 24, 2000

(86) PCT No.: PCT/EP00/11904

§ 371 (c)(1),
(2), (4) Date: Aug. 27, 2002

(87) PCT Pub. No.: WO01/38692

PCT Pub. Date: May 31, 2001

(30) Foreign Application Priority Data

Nov. 24, 1999 (EP) ..... 99309376

(51) Int. Cl.[7] ..... E21B 29/10; E21B 33/124; E21B 33/128

(52) U.S. Cl. ..... 166/196; 166/387; 166/191; 166/192; 285/381.2; 285/381.3

(58) Field of Search ..... 166/387, 277, 166/196, 191, 192; 285/187, 381.1, 381.2, 381.3

(56) References Cited

U.S. PATENT DOCUMENTS

| | | | |
|---|---|---|---|
| 4,489,964 | A | 12/1984 | Kipp et al. |
| 4,515,213 | A | 5/1985 | Rogen et al. |
| 4,621,844 | A | 11/1986 | Kipp et al. |
| 4,713,870 | A | 12/1987 | Szalvay |
| 5,199,497 | A | 4/1993 | Ross |
| 5,787,933 | A | 8/1998 | Russ et al. |

OTHER PUBLICATIONS

Search Report dated Jul. 30, 2001.

*Primary Examiner*—David Bagnell
*Assistant Examiner*—G M Collins

(57) ABSTRACT

A device for sealing off an opening through the wall of a well tubular, which device comprises a tubular spacer having an outer diameter allowing the spacer to be arranged in the well tubular, a first seal collar assembly and a second seal collar assembly arranged opposite ends of the tubular spacer, each seal collar assembly comprising an activator ring and an annular seal collar, the activator rings being interconnected by a cylindrical system of shape memory alloy which system contracts when the temperature of the cylindrical system reaches the transition temperature of the shape memory alloy, and wherein each annular seal collar is arranged so as to be compressed against the inner surface of the well tubular upon contraction of the cylindrical system of shape memory alloy.

13 Claims, 2 Drawing Sheets

SEALING OFF OPENINGS THROUGH THE WALL OF A WELL TUBULAR

BACKGROUND OF THE INVENTION

Field of the Invention

Figure 1:
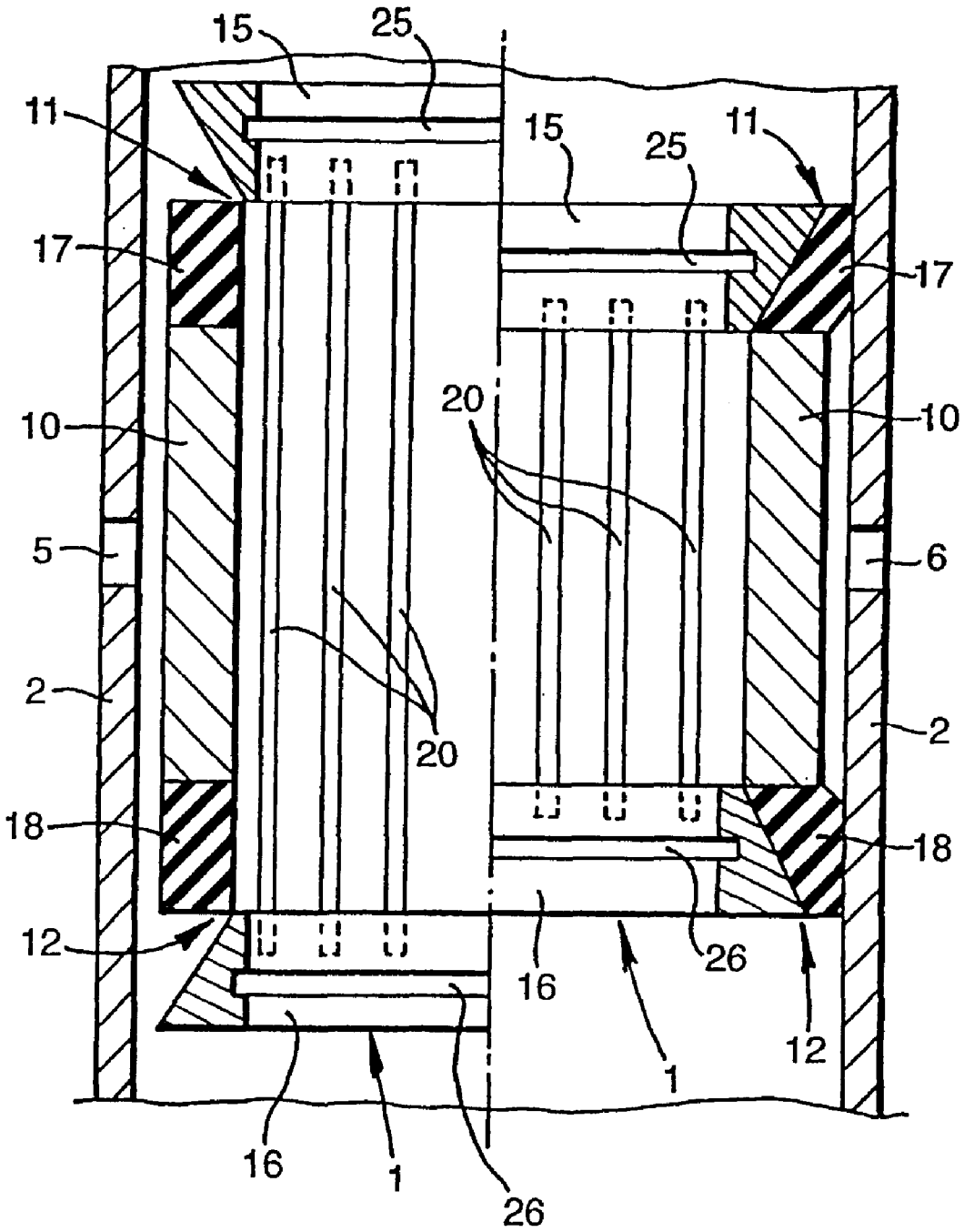

The present invention relates to a device for sealing off openings through the wall of a well tubular, which well tubular is a production tubing, a casing or a liner. Such a device is also referred to as 'sliding sleeve', or when used for cementing as 'cementing collar'.

It is well known that a well for producing hydrocarbons from an underground reservoir comprises a borehole that is lined with a well tubular in the form of a casing or a liner. The annular space between the outer surface of the well tubular and the inner surface of the borehole is filled with cement, which cement is put in place following inserting the casing in the borehole. Putting the cement in place is done by pumping a volume of cement through the well tubular and allowing it to rise in the annular space from the bottom of the borehole to the required level. When the borehole is deep and consequently the casing very long, single stage cementing is not possible because of the high pressures generated at the casing shoe. Therefore, cementing is done in stages. The first stage is cemented from the bottom to a pre-determined level. The second stage employs the use of a cementing collar or sliding sleeve that is an element of the casing. This cementing collar allows selectively placement of cement by uncovering holes in the wall of the well tubular at the level of the cementing collar. In order be able to pump the cement through the holes, a plug is set just below the holes. Then cement is supplied into the annular space through these holes. Having finalized the second stage, the holes are closed by adjusting the position of the sliding sleeve of the cement collar.

SUMMARY OF THE INVENTION

It is an object of the present invention to provide a device for sealing off openings through the wall of a well tubular that can easily be set and that has a good sealing ability.

DETAILED DESCRIPTION OF THE INVENTION

In accordance with the invention there is provided a device for sealing off an opening through the wall of a well tubular, which device comprises a tubular spacer having an outer diameter allowing the spacer to be arranged in the well tubular, a first seal collar assembly and a second seal collar assembly arranged opposite ends of the tubular spacer, each seal collar assembly comprising an activator ring and an annular seal collar, the activator rings being interconnected by a cylindrical system of shape memory alloy which system contracts when the temperature of the cylindrical system reaches the transition temperature of the shape memory alloy, and wherein each annular seal collar is arranged so as to be compressed against the inner surface of the well tubular upon contraction of the cylindrical system of shape memory alloy.

In the specification and the claims, the term 'shape-memory alloy' is used to refer to an alloy that exhibits a shape-memory effect, wherein a complete recovery of a deformation undergone at a particular temperature takes place at heating. The skilled person is able to select a composition of the alloy material that exhibits the required effects at the temperatures prevailing in the well.

An advantage of the device according to the present invention is that is does not form a part of the well tubular. Therefore it can be set there where from an operational point of view a hole in the well tubular is needed that has to be closed after use.

The device according to the present invention can also be applied to seal off holes in the wall of a perforated casing. In this case the casing wall is perforated to allow production from an underground reservoir. In this case production management can be applied.

The device can also be used for repair jobs, wherein holes in a well tubular caused by corrosion and wear have to be closed.

Suitably each annular seal collar is arranged between the activator ring of the respective seal collar assembly and the tubular spacer.

In a preferred embodiment said cylindrical system is substantially coaxially arranged within the spacer. In this manner there remains a central passage for tools or fluid in the well tubular.

The cylindrical system can, for example, includes a tubular element of shape memory alloy.

Alternatively the system can include a plurality of rods of shape memory alloy, the rods being circumferentially spaced along the cylindrical system.

DETAILED DESCRIPTION OF THE FIGURES

Figure 2:
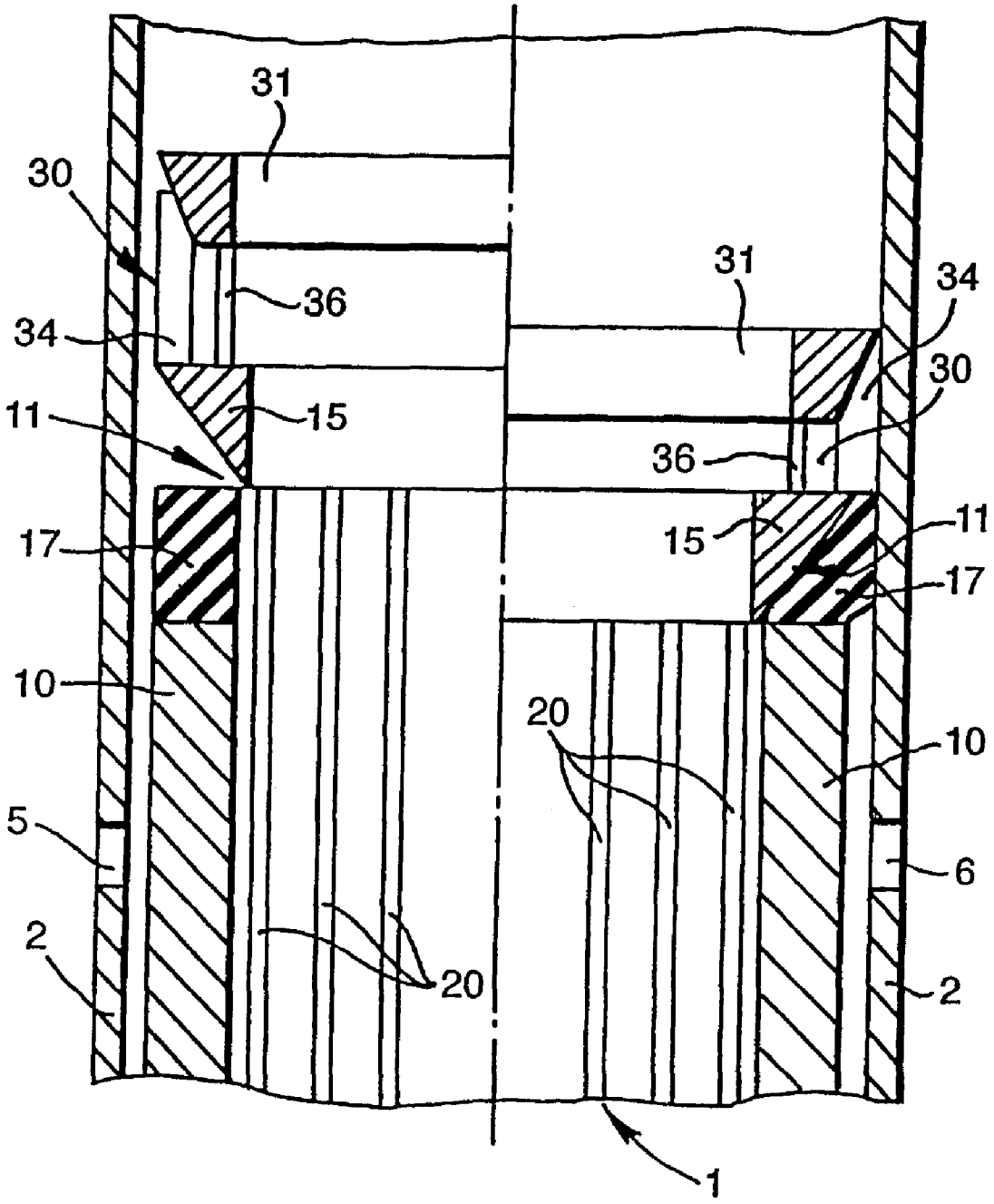

The invention will now be described in more detail with reference to the accompanying drawings, wherein FIG. 1 shows schematically a cross-section of a first embodiment of the present invention, and wherein FIG. 2 shows schematically a cross-section of the upper part of a second embodiment of the present invention.

Reference is now made to FIG. 1, showing schematically a cross-section of the device 1 according to the present invention in a first position in which it is lowered into a well tubular 2 (at the left-hand side of FIG. 1, and in a second position in which it is set in the well tubular 2 (at the right-hand side of FIG. 1). To illustrate the present invention, the wall of the well tubular 2 is provided with two openings 5 and 6.

The device 1 comprises a tubular spacer 10 that has an outer diameter that is less than the inner diameter of the well tubular 2. The device 1 further comprises a first seal collar assembly 11 and a second seal collar assembly 12 arranged opposite ends of the tubular spacer 10. Each seal collar assembly 11, 12 comprises an activator ring 15 and 16 and an annular seal collar 17, 18 located between the activator ring 15, 16 and the tubular spacer 10. The activator rings 15 and 16 have a wedge-shaped cross-section, wherein the sharp ends of the wedges point towards each other. The annular seal collars 17 are made of a suitable elastomeric material.

The device further comprises a plurality of rods 20 of a shape-memory alloy connecting the activator rings 15 and 16, and to this end the ends of the rods 20 are secured to the activator rings 15 and 16. The rods 20 are evenly placed around the circumference of the activator rings 15 and 16.

The shape-memory alloy is so selected that during normal operation when the temperature of the rods is above a preselected temperature, the rods 20 contract.

During normal operation the device 1 is expanded, by applying tension to the activator rings 15 and 16 at ambient temperature. In this running position the device 1 is lowered into the well tubular to the desired location, where there is an opening in the wall of the well tubular that needs to be closed, see the left-hand part of FIG. 1. Heat from the formation around the well, or from an external source, causes the rods 20 to contract, and the activator rings 15 and 16 are pulled towards each other. This causes the annular seal collars 17 and 18 to deform and they are pressed against the inner surface of the wall of the well tubular 2 so as to seal off the opening 6, see right-hand part of FIG. 1.

An advantage of the device according to the invention is that since the rods 20 are evenly placed along the circumference of the activator rings 15 and 16, the pulling force is also evenly distributed. Therefore the device according to the present invention has a good sealing ability. Moreover, as the temperature in the well may be the activator, the device is easily set under most conditions.

In order to be able to displace the device 1 through the well, the activator rings 15 and 16 are suitably provided with an annular recess 25 and 26, to which a suitable landing tool (not shown) can be latched. Providing both activator rings 15 and 16 with an annular recess 25 and 26 has the advantage that the device is symmetrical.

The embodiment shown in FIG. 1 is particularly suited for production control or for repair jobs.

Suitably more than one device according to the present invention can be arranged in the well tubular, so as to be able to manage more effectively the production or to carry out larger repair jobs.

Reference is now made to FIG. 2. Features of the device that have already been discussed with reference to FIG. 1 have been given the same reference numeral as in FIG. 1. The embodiment of FIG. 2 is particularly suited for cementing jobs and heavier repair jobs because the device can withstand high loads in axial direction.

The device 1 further comprises releasable means 30 for fixing the position of the device 1 in the well tubular 2. The releasable fixing means 30 comprise a wedge-shaped ring 31 and a plurality of slips 34 that are provided with teeth (not shown) so that the slips 34 can have a firm grip on the inner surface of the well tubular 2. The wedge-shaped ring 31 is joined to the activator ring 15 by means of a plurality of rods 36 of a shape-memory alloy. The rods 36 contract during normal operation when the temperature of the rods 36 is above a preselected temperature.

The other side of the device 1 (not shown) is provided with similar releasable means for fixing the position of the device 1 in the well tubular 2.

During normal operation the device 1 is expanded, by applying tension to the ring 31 and the ring (not shown at the other end at ambient temperature. In this running position the device 1 is lowered into the well tubular to the desired location, where there is an opening in the wall of the well tubular that needs to be closed, see the left-hand part of FIG. 2. Heat from the formation or from an external source causes the rods 20 and 36 to contract, wherein the shape-memory alloys are so selected that at the prevailing conditions the rods 20 contract before the rods 36 contract. The rings 31 and the activator rings 15 and 16 are pulled towards each other. Consequently the slips 34 are pressed against the inner surface of the well tubular 2 and the annular seal collars 17 and 18 are deformed and they are pressed against the inner surface of the wall of the well tubular 2 so as to seal off the opening 6, see right-hand part of FIG. 2.

This embodiment is suitably used when the device according to the present invention is used in a cementing operation.

The wedge-shaped ring 31 can be provided with an annular recess (not shown), to which a suitable landing tool (not shown) can be latched to land or to retrieve the device.

The device according to the present invention can easily be retrieved from the well tubular by applying so much tension that the device is returned to the running position.

What is claimed is:

1. A device for sealing off an opening through the wall of a well tubular, which device comprises a tubular spacer having an outer diameter allowing the spacer to be arranged in the well tubular, a first seal collar assembly and a second seal collar assembly arranged opposite ends of the tubular spacer, each seal collar assembly comprising an activator ring and an annular seal collar, the activator rings being interconnected by a cylindrical system of shape memory alloy which system contracts when the temperature of the cylindrical system reaches the transition temperature of the shape memory alloy, and wherein each annular seal collar is arranged so as to be compressed against the inner surface of the well tubular upon contraction of the cylindrical system of shape memory alloy.

2. The device of claim 1, wherein each annular seal collar is arranged between the activator ring of the respective seal collar assembly and the tubular spacer.

3. The device of claim 1, wherein said cylindrical system is substantially coaxially arranged within the spacer.

4. The device of claim 1, wherein the cylindrical system includes a tubular element of shape memory alloy.

5. The device of claim 1, wherein the cylindrical system includes a plurality of rods of shape memory alloy, the rods being circumferentially spaced along the cylindrical system.

6. The device of claim 1, further comprising releasable means for fixing the position of the device.

7. The device of claim 6, wherein the releasable means comprise a plurality of slips, a wedge-shaped ring and a plurality of rods of a shape-memory alloy connecting the ring to the activator ring, which rods contract during normal operation when the temperature of the rods is above a preselected temperature.

8. A method for sealing off an opening through the wall of a well tubular, which method comprises:

arranging a first seal collar assembly and a second seal collar assembly at opposite ends of the tubular spacer wherein each seal collar assembly comprising an activator ring and an annular seal collar, the activator rings being interconnected by a cylindrical system of shape memory alloy which system contracts when the temperature of the cylindrical system reaches the transition temperature of the shape memory alloy; and arranging each annular seal collar so as to be compressed against the inner surface of the well tubular upon contraction of the cylindrical system of shape memory alloy.

9. The method of claim 8, further comprising arranging each annular seal collar between the activator ring of the respective seal collar assembly and the tubular spacer.

10. The method of claim 8, further comprising coaxially arranging said cylindrical system within the spacer.

11. The method of claim 8, wherein the activator rings being interconnected by the cylindrical system and said system includes a tubular element of shape memory alloy.

12. The method of claim 8, wherein the cylindrical system includes a plurality of rods of shape memory alloy, the rods being circumferentially spaced along the cylindrical system.

13. The method of claim 8, further comprising arranging each annular seal collar so as to compress against the inner surface.

* * * * *